US009145770B2

(12) United States Patent
Hirata et al.

(10) Patent No.: US 9,145,770 B2
(45) Date of Patent: Sep. 29, 2015

(54) SCROLL COMPRESSOR WITH STEPPED SPIRAL WRAPS

(75) Inventors: Hirohumi Hirata, Aichi (JP); Tetsuzo Ukai, Aichi (JP); Hiroshi Yamazaki, Aichi (JP); Takahide Ito, Aichi (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 925 days.

(21) Appl. No.: 13/123,836

(22) PCT Filed: Apr. 22, 2010

(86) PCT No.: PCT/JP2010/057123

§ 371 (c)(1),
(2), (4) Date: May 9, 2011

(87) PCT Pub. No.: WO2010/125961

PCT Pub. Date: Nov. 4, 2010

(65) Prior Publication Data

US 2011/0200475 A1 Aug. 18, 2011

(30) Foreign Application Priority Data

Apr. 27, 2009 (JP) ..... 2009-107698

(51) Int. Cl.
*F04C 18/02* (2006.01)
*F01C 17/06* (2006.01)

(52) U.S. Cl.
CPC ..... *F01C 17/063* (2013.01); *F04C 18/0215* (2013.01); *F04C 18/0276* (2013.01); *F04C 2270/13* (2013.01)

(58) Field of Classification Search
CPC ..... F04C 18/0276; F04C 18/0215; F04C 2270/13
USPC ..... 418/55.2
See application file for complete search history.

(56) References Cited

U.S. PATENT DOCUMENTS 4,457,674 A * 7/1984 Kawano et al. ..... 418/55.2
4,477,238 A * 10/1984 Terauchi ..... 418/55.2

(Continued)

FOREIGN PATENT DOCUMENTS

CN 1127848 A 7/1996
JP 60-104788 A 6/1985

(Continued)

OTHER PUBLICATIONS

International Search Report of PCT/JP2010/057123, mailing date Jun. 22, 2010.

(Continued)

*Primary Examiner* — Mary A Davis
(74) *Attorney, Agent, or Firm* — Westerman, Hattori, Daniels & Adrian, LLP

(57) ABSTRACT

An object is to provide a scroll compressor capable of preventing degradation in performance and the occurrence of abnormal noise due to a torsional moment applied to an orbiting scroll, by utilizing the structural advantages of so-called stepped scroll compressors. In a so-called stepped scroll compressor (1), in a pair of compression chambers (16) arranged in a point-symmetrical configuration among a plurality of compression chambers (16), the volume V1 of the compression chamber (16) formed on the ventral-surface side of the fixed spiral wrap (14B) of the fixed scroll (14) when intake is cut off and the volume V2 of the compression chamber (16) formed on the ventral-surface side of the orbiting spiral wrap (15B) of the orbiting scroll (15) are different from each other.

6 Claims, 4 Drawing Sheets

(56) References Cited

U.S. PATENT DOCUMENTS

| | | | | |
|---|---|---|---|---|
| 4,626,179 | A | 12/1986 | Terauchi | |
| 4,859,159 | A * | 8/1989 | Leptien | 418/55.2 |
| 5,340,292 | A | 8/1994 | Steele | |
| 6,746,224 | B2 * | 6/2004 | Itoh et al. | 418/55.2 |

FOREIGN PATENT DOCUMENTS

| | | | |
|---|---|---|---|
| JP | 05-071477 | A | 3/1993 |
| JP | 07-503051 | A | 3/1995 |
| JP | 2002-005053 | A | 1/2002 |
| JP | 2002-180976 | A | 6/2002 |
| JP | 2004-116307 | A | 4/2004 |
| JP | 3540380 | B2 | 7/2004 |

OTHER PUBLICATIONS

Chinese Office Action dated Jun. 26, 2013, issued in Chinese Patent Application No. 201080003042.0, w/English translation.

* cited by examiner

SCROLL COMPRESSOR WITH STEPPED SPIRAL WRAPS

TECHNICAL FIELD

The present invention relates to a so-called stepped scroll compressor, in which a pair of a fixed scroll and an orbiting scroll forming compression chambers have step portions provided in the spiral direction.

BACKGROUND ART

Conventionally, a scroll compressor in which each of a fixed scroll and an orbiting scroll has step portions provided at arbitrary positions in the spiral direction of the top surfaces and bottom surfaces of spiral wraps, and in which the spiral wraps having a higher wrap height on the outer circumferential side with respect to the step portions than on the inner circumferential side is known (for example, see PTL 1). Since the height of the compression chambers in the axial direction is higher on the outer circumferential side than on the inner circumferential side of the spiral wraps, this scroll compressor constitutes a scroll compressor capable of three-dimensional compression, i.e., compressing gas both in the circumferential direction and the height direction of the spiral wraps. Thus, a high-performance, compact, and light weight scroll compressor is achieved.

On the other hand, a scroll compressor has a pin-ring-type or Oldham's-ring-type rotation preventing mechanism for preventing rotation produced when the orbiting scroll is orbitally revolved. The rotation preventing mechanism, the fixed scroll, and the orbiting scroll inevitably have dimensional tolerances or assembly tolerances because they are components. Accordingly, it is difficult to completely prevent rotation of the orbiting scroll with the rotation preventing mechanism. Therefore, when the orbiting scroll receives a torsional moment in the orbital direction caused by a compression reaction force, a centrifugal force, or the like during operation, it inevitably rotates in a rocking (vibrating) manner by an amount corresponding to the above-mentioned tolerances. As a result, the spiral wrap of the orbiting scroll periodically comes into contact with and is separated from the spiral wrap of the fixed scroll, causing degradation in performance due to gas leakage and abnormal noise due to impacts.

To counter this, PTL 2 discloses a technique in which one or both of the ventral-surface side of the spiral wrap of the fixed scroll and the dorsal-surface side of the spiral wrap of the orbiting scroll are slightly cut. This reduces rocking (vibration) caused by the orbiting scroll coming into contact with and being separated from the spiral wrap of the fixed scroll when it receives a torsional moment in the orbital direction, and prevents degradation in performance due to gas leakage and abnormal noise due to impacts.

PTL 3 discloses a technique in which a pin on a housing side of a pin-ring-type rotation preventing mechanism is fixed at a position shifted in the direction opposite to the orbital direction by an amount corresponding to the tolerance and in which a knock pin for positioning a fixed scroll is disposed at a position satisfying positioning requirements determined such that, when an orbiting scroll is allowed to rotate in the orbital direction or the opposite direction, a gap between spiral wraps of the scrolls is a predetermined gap dimension. This prevents degradation in performance due to gas leakage and abnormal noise due to impacts.

CITATION LIST

Patent Literature

{PTL 1} Japanese Unexamined Patent Application, Publication No. 2002-5053
{PTL 2} the Publication of Japanese Patent No. 3540380
{PTL 3} Japanese Unexamined Patent Application, Publication No. 2002-180976

SUMMARY OF INVENTION

Technical Problem

However, both techniques disclosed in PTLs 2 and 3 are intended to prevent degradation in performance and the occurrence of abnormal noise caused by the orbiting scroll rotating in a rocking (vibrating) manner by adding, in advance, a torsion in the direction opposite to a torsion in the orbital direction by an amount corresponding to the variation due to dimensional tolerances or assembly tolerances of the components by cutting the wrap faces or by adjusting the pin positions with respect to an ideal state in which a gap between the spiral wraps of the scrolls is 0 (zero), thereby stabilizing the behavior of the orbiting scroll. This means that a gap larger than 0 (zero) is set with respect to the ideal state in which the gap is 0. This inevitably leads to a reduction in the absolute value of the performance and variations in operation noise due to vibration.

The present invention has been made in view of the above-described circumstances, and an object thereof is to provide a scroll compressor that can prevent degradation in performance and the occurrence of abnormal noise due to a torsional moment applied to the orbiting scroll, utilizing the structural advantages of so-called stepped scroll compressors.

Solution to Problem

To solve the above-described problems, a scroll compressor of the present invention employs the following solutions.

That is, a scroll compressor of the present invention includes a fixed scroll in which a fixed spiral wrap is disposed upright on a surface of a fixed end plate; an orbiting scroll in which an orbiting spiral wrap is disposed upright on a surface of an orbiting end plate, the orbiting scroll being meshed with the fixed scroll, forming a plurality of compression chambers arranged in a point-symmetrical configuration; and a rotation preventing mechanism that allows the orbiting scroll to orbitally revolve around the fixed scroll while preventing rotation of the orbiting scroll. The fixed scroll and the orbiting scroll each have a step portion at an arbitrary position in a spiral direction of the spiral wrap, the spiral wrap having a higher wrap height on an outer circumferential side than on an inner circumferential side. A pair of compression chambers arranged in a point-symmetrical configuration among the compression chambers are configured such that a volume V1 of the compression chamber formed on a ventral-surface side of the fixed spiral wrap of the fixed scroll when intake is cut off and a volume V2 of the compression chamber formed on a ventral-surface side of the orbiting spiral wrap of the orbiting scroll are different.

According to the present invention, a pair of compression chambers arranged in a point-symmetrical configuration are configured such that a volume V1 of the compression chamber formed on the ventral-surface side of the fixed spiral wrap of the fixed scroll when intake is cut off and a volume V2 of the compression chamber formed on the ventral-surface side of the orbiting spiral wrap of the orbiting scroll are different. Thus, it is possible to prevent the orbiting scroll from rotating in a rocking (vibrating) manner by balancing a torsional moment in the orbital direction or the opposite direction caused by various forces and applied to the orbiting scroll depending on the operating conditions by a torsional moment in the direction opposite thereto caused by the pressure of the compression chamber having a larger volume, thereby stabilizing the behavior of the orbiting scroll. Accordingly, there is no need to set a gap larger than 0 (zero) to give a torsion between the spiral wraps of the scrolls in advance, and it is possible to prevent a reduction in the absolute value of the performance, the occurrence of abnormal noise due to impacts and the like, to improve and stabilize the performance, and to reduce operation noise.

Furthermore, in a scroll compressor of the present invention, the above-described scroll compressor may be configured such that a relationship between the volume V1 of the compression chamber formed on the ventral-surface side of the fixed spiral wrap of the fixed scroll and the volume V2 of the compression chamber formed on the ventral-surface side of the orbiting spiral wrap of the orbiting scroll is V1>V2.

With this configuration, the relationship between the volume V1 of the compression chamber formed on the ventral-surface side of the fixed spiral wrap of the fixed scroll and the volume V2 of the compression chamber formed on the ventral-surface side of the orbiting spiral wrap of the orbiting scroll is V1>V2. Thus, it is possible to prevent the orbiting scroll from rotating in a rocking (vibrating) manner in the orbital direction by balancing a torsional moment in the orbital direction caused by a compression reaction force or a centrifugal force and applied to the orbiting scroll by a torsional moment in the direction opposite to the orbital direction caused by the pressure of the compression chamber having a larger volume V1 and formed on the ventral-surface side of the fixed spiral wrap. Accordingly, it is possible to prevent degradation in performance and impact noise caused by a torsional moment applied to the orbiting scroll, to improve and stabilize the performance, and to reduce operation noise.

Furthermore, in a scroll compressor of the present invention, the above-described scroll compressor may be configured such that a relationship between the volume V1 of the compression chamber formed on the ventral-surface side of the fixed spiral wrap of the fixed scroll and the volume V2 of the compression chamber formed on the ventral-surface side of the orbiting spiral wrap of the orbiting scroll is V1<V2.

With this configuration, the relationship between the volume V1 of the compression chamber formed on the ventral-surface side of the fixed spiral wrap of the fixed scroll and the volume V2 of the compression chamber formed on the ventral-surface side of the orbiting spiral wrap of the orbiting scroll is V1<V2. Thus, even in a case where a torsional moment in the orbital direction applied to the orbiting scroll depending on the operating conditions is reversed, it can be suppressed by a torsional moment in the orbital direction caused by the pressure of the compression chamber formed on the ventral-surface side of the orbiting spiral wrap and having a larger volume V2. Accordingly, it is possible to prevent degradation in performance and impact noise caused by a reversed torsional moment applied to the orbiting scroll, to improve and stabilize the performance, and to reduce operation noise.

Furthermore, in a scroll compressor of the present invention, any one of the above-described scroll compressors may be configured such that the volume V1 of the compression chamber formed on the ventral-surface side of the fixed spiral wrap of the fixed scroll and the volume V2 of the compression chamber formed on the ventral-surface side of the orbiting spiral wrap of the orbiting scroll are differentiated from each other by shifting positions at which the step portions present in the compression chambers are provided in the spiral direction.

With this configuration, the volume V1 of the compression chamber formed on the ventral-surface side of the fixed spiral wrap of the fixed scroll and the volume V2 of the compression chamber formed on the ventral-surface side of the orbiting spiral wrap of the orbiting scroll are differentiated from each other by shifting the positions at which the step portions present in the compression chambers are provided in the spiral direction. Thus, when the volume V1 of the compression chamber formed on the ventral-surface side of the fixed spiral wrap is to be increased, V1>V2 can be achieved by shifting the step portions present in that compression chamber toward the inner circumferential end of the fixed spiral wrap. Conversely, when the volume V2 of the compression chamber formed on the ventral-surface side of the orbiting spiral wrap is to be increased, V2>V1 can be achieved by shifting the step portions present in that compression chamber toward the inner circumferential end of the orbiting spiral wrap. Accordingly, the volumes V1 and V2 of a pair of compression chambers can be easily unbalanced by utilizing the structural advantages of so-called stepped scroll compressors.

Furthermore, in the scroll compressor of the present invention, any one of the above-described scroll compressors may be configured such that the volume V1 of the compression chamber formed on the ventral-surface side of the fixed spiral wrap of the fixed scroll and the volume V2 of the compression chamber formed on the ventral-surface side of the orbiting spiral wrap of the orbiting scroll are differentiated by changing a height in an axial direction of the outer circumferential side of the spiral wraps forming the respective compression chambers.

With this configuration, the volume V1 of the compression chamber formed on the ventral-surface side of the fixed spiral wrap of the fixed scroll and the volume V2 of the compression chamber formed on the ventral-surface side of the orbiting spiral wrap of the orbiting scroll are differentiated by changing the height in the axial direction of the outer circumferential side of the spiral wraps forming the respective compression chambers. Thus, when the volume V1 of the compression chamber formed on the ventral-surface side of the fixed spiral wrap is to be increased, V1>V2 can be achieved by increasing the height in the axial direction (=the height of the step portion) of the outer circumferential side of the fixed spiral wrap forming that compression chamber. Conversely, when the volume V2 of the compression chamber formed on the ventral-surface side of the orbiting spiral wrap is to be increased, V2>V1 can be achieved by increasing the height in the axial direction (=the height of the step portion) of the outer circumferential side of the orbiting spiral wrap forming that compression chamber. Accordingly, the volumes V1 and V2 of a pair of compression chambers can be easily unbalanced by utilizing the structural advantages of so-called stepped scroll compressors.

Advantageous Effects of Invention

In the present invention, it is possible to prevent the orbiting scroll from rotating in a rocking (vibrating) manner by balancing a torsional moment in the orbital direction or the opposite direction caused by various forces and applied to the orbiting scroll depending on the operating conditions by a torsional moment in the direction opposite thereto caused by the pressure of the compression chamber having a larger volume, thereby stabilizing the behavior of the orbiting scroll. Accordingly, there is no need to set a gap larger than 0 (zero) to give a torsion between the spiral wraps of the scrolls in advance, and it is possible to prevent a reduction in the absolute value of the performance, the occurrence of abnormal noise due to impacts and the like, to improve and stabilize the performance, and to reduce operation noise.

DESCRIPTION OF EMBODIMENTS

Embodiments of the present invention will be described below with reference to the drawings.

First Embodiment

A first embodiment of the present invention will be described below using FIGS. 1, 2, and 4.

Figure 1:
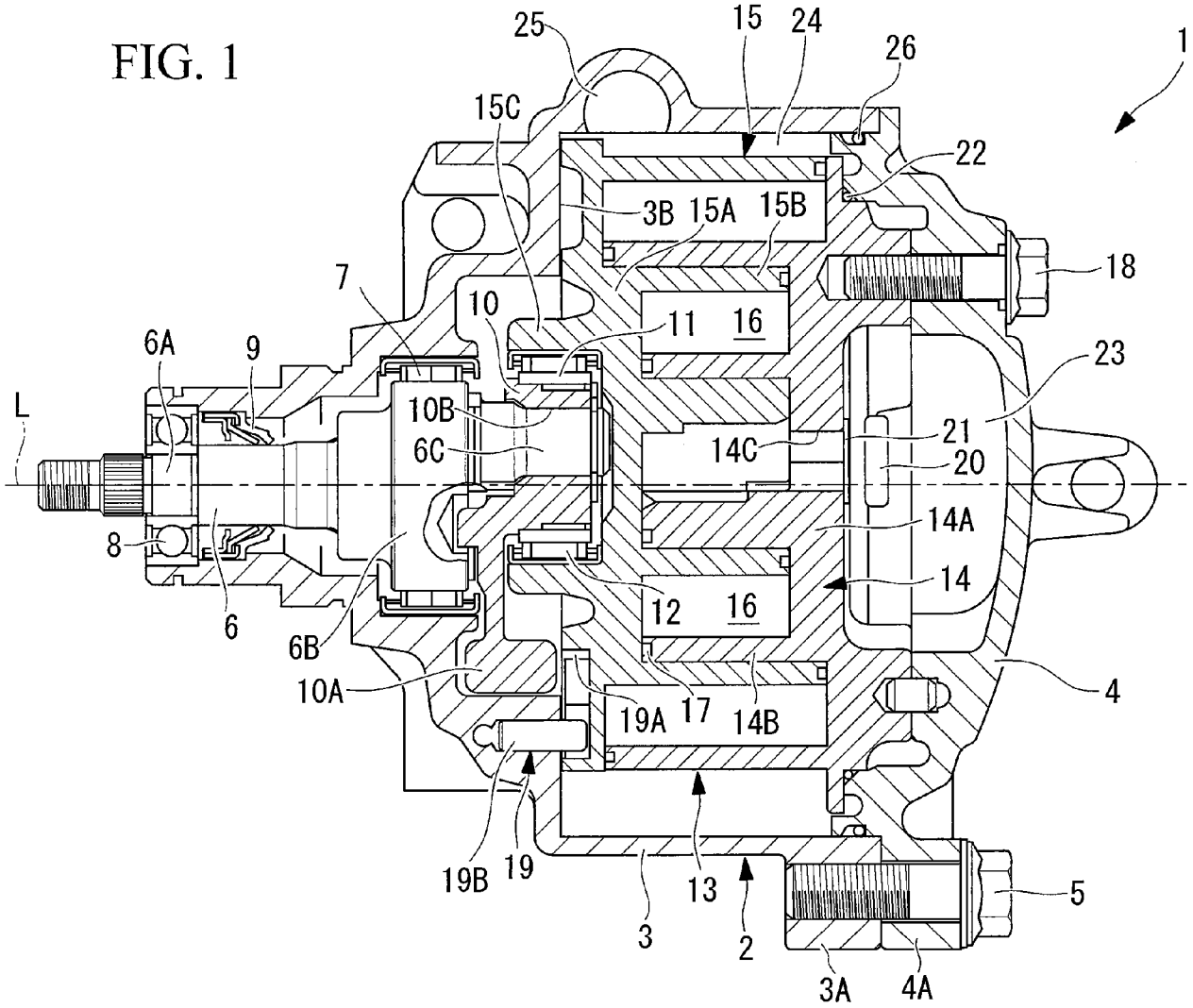
FIG. 1 is a vertical cross-sectional view of a scroll compressor according to a first embodiment of the present invention.
Figure 2:
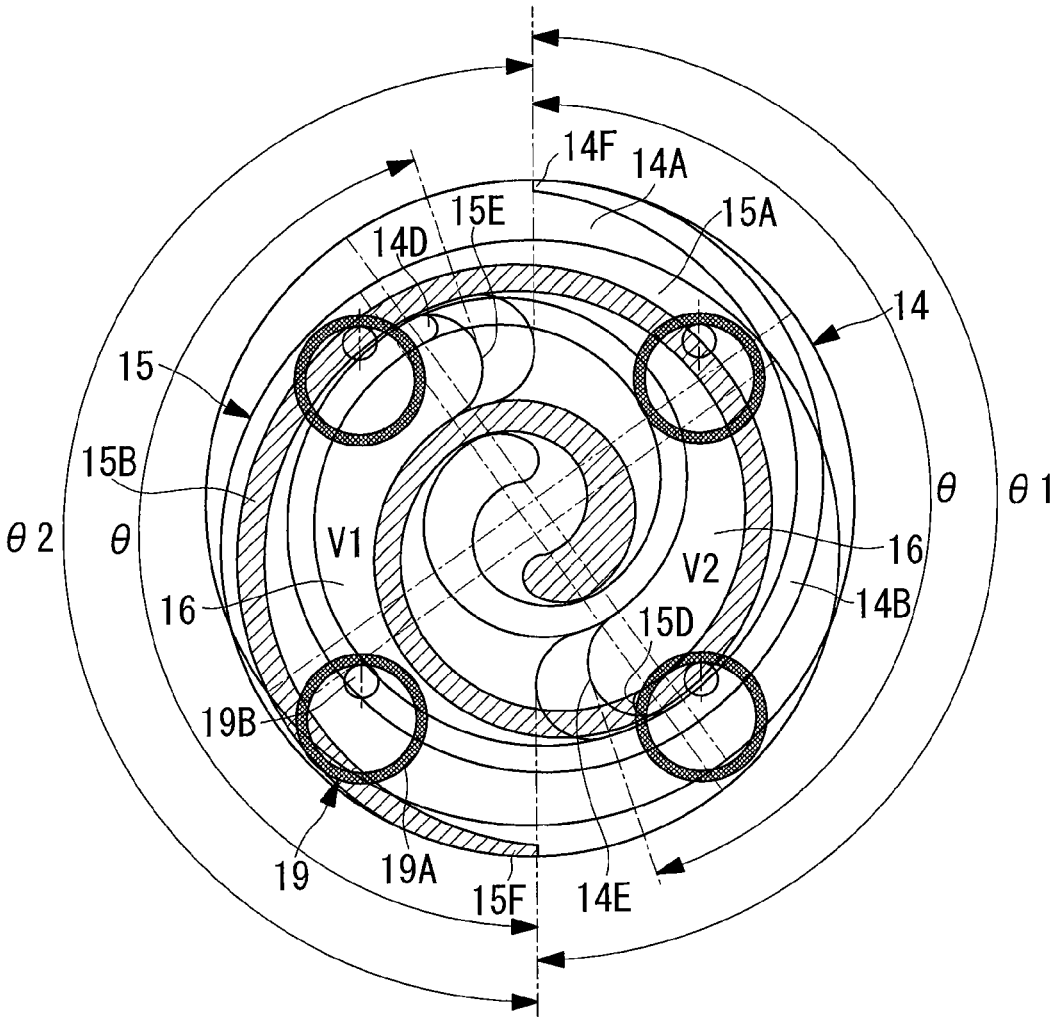
FIG. 2 is a plan view showing a meshed state of a fixed scroll and an orbiting scroll of the scroll compressor shown in FIG. 1.

FIG. 1 shows a vertical cross-sectional view of a scroll compressor according to a first embodiment of the present invention. A scroll compressor 1 includes a housing 2 constituting an outer shell. The housing 2 is formed of a front housing 3 and a rear housing 4 that are securely fastened together with bolts 5. The front housing 3 and the rear housing 4 have fastening flanges 3A and 4A that are integrally formed at a plurality of, for example, four, positions on the circumference at regular intervals. By fastening together these flanges 3A and 4A with the bolts 5, the front housing 3 and the rear housing 4 are connected into a single component.

Inside the front housing 3, a crankshaft (drive shaft) 6 is supported so as to be rotatable about its axis L via a main bearing 7 and a sub-bearing 8. An end (the left side in FIG. 1) of the crankshaft 6 serves as a small-diameter shaft portion 6A. The small-diameter shaft portion 6A extends through the front housing 3 and protrudes from the left side in FIG. 1. An electromagnetic clutch, a pulley, or other known means (not shown) are provided for receiving the motive power at the protruded portion of the small-diameter shaft portion 6A, to which the motive power from a drive source, such as an engine, is transmitted via a V belt or the like. A mechanical seal (lip seal) 9, which seals between the inside of the housing 2 and the atmosphere in an air-tight manner, is disposed between the main bearing 7 and the sub-bearing 8.

The other end (the right side in FIG. 1) of the crankshaft 6 serves as a large-diameter shaft portion 6B. The large-diameter shaft portion 6B has an integrally provided crankpin 6C that is offset from the axis L of the crankshaft 6 by a predetermined dimension. The large-diameter shaft portion 6B and the small-diameter shaft portion 6A are supported by the front housing 3 via the main bearing 7 and the sub-bearing 8 such that the crankshaft 6 is supported in a rotatable manner. An orbiting scroll 15 (described below) is connected to the crankpin 6C via a drive bush 10, a cylindrical ring (floating bush) 11, and a drive bearing 12. Rotation of the crankshaft 6 causes the orbiting scroll 15 to be orbitally driven.

A balance weight 10A for eliminating an unbalanced load produced when the orbiting scroll 15 is orbitally driven is formed integrally with the drive bush 10, and it orbits as the orbiting scroll 15 is orbitally driven. The drive bush 10 has a crankpin hole 10B to which the crankpin 6C is fitted at an off-center position. With this configuration, the orbiting scroll 15 and the drive bush 10 fitted to the crankpin 6C receive a compression reaction force of the gas and are rotated about the crankpin 6C, forming a known driven crank mechanism that provides a variable orbital radius of the orbiting scroll 15.

The housing 2 accommodates a scroll compression mechanism 13 formed of a fixed scroll 14 and the orbiting scroll 15, forming a pair. The fixed scroll 14 is formed of a fixed end plate 14A and a fixed spiral wrap 14B disposed upright on the fixed end plate 14A, and the orbiting scroll 15 is formed of an orbiting end plate 15A and an orbiting spiral wrap 15B disposed upright on the end plate 15A.

The above-described fixed scroll 14 and the orbiting scroll 15 have step portions 14D and 14E and 15D and 15E provided at predetermined positions in the spiral direction of the top surfaces and bottom surfaces of the spiral wraps 14B and 15B (see FIG. 2), respectively. The height in the orbital axis direction of the top surfaces of the wraps is higher on the outer circumferential side than on the inner circumferential side, with respect to these step portions 14D, 14E, 15D, and 15E. The height in the orbital axis direction of the bottom surfaces is lower on the outer circumferential side than on the inner circumferential side. With this configuration, in each of the spiral wraps 14B and 15B, the wrap height on the outer circumferential side is higher than the wrap height on the inner circumferential side.

The fixed scroll 14 and the orbiting scroll 15 are meshed such that the centers thereof are separated by a distance corresponding to the orbital radius and such that the phases of the spiral wraps 14B and 15B are shifted by 180 degrees, and are assembled such that a slight clearance (of several tens to several hundreds of microns) is left in the wrap height direction between the top surfaces and bottom surfaces of the spiral wraps 14B and 15B at standard temperature. In this way, as shown in FIG. 1, a plurality of pairs of compression chambers 16, which are arranged in a point-symmetrical configuration with respect to the centers of the scrolls and are defined by the end plates 14A and 15A and the spiral wraps 14B and 15B, are formed between the scrolls 14 and 15, and the orbiting scroll 15 is configured to be able to smoothly orbit around the fixed scroll 14.

Since the height of the compression chambers 16 in the orbital axis direction is higher on the outer circumferential side than on the inner circumferential side of the spiral wraps 14B and 15B, the compression chambers 16 constitute the scroll compression mechanism 13 capable of three-dimensional compression, i.e., compressing gas both in the circumferential direction and the height direction of the spiral wraps 14B and 15B. A tip seal 17 for sealing a tip seal surface formed with respect to the bottom surface of the counterpart scroll is provided on each of the top surfaces of the spiral wraps 14B and 15B of the fixed scroll 14 and the orbiting scroll 15, such that it is fitted into a groove provided in the top surface, respectively.

The fixed scroll 14 is fixed to an inner surface of the rear housing 4 with a bolt 18. As described above, the crankpin 6C provided at an end of the crankshaft 6 is connected to a boss portion 15C provided in the back surface of the orbiting end plate 15A via the drive bush 10, the cylindrical ring (floating bush) 11, and the drive bearing 12, whereby the orbiting scroll 15 is configured to be orbitally driven.

Furthermore, the orbiting scroll 15 is configured such that the back surface of the orbiting end plate 15A is supported by a thrust receiving surface 3B of the front housing 3 and such that it is orbitally revolved and driven around the fixed scroll 14 while being prevented from rotating by a rotation preventing mechanism 19 provided between the thrust receiving surface 3B and the back surface of the orbiting end plate 15A. The rotation preventing mechanism 19 according to this embodiment is a pin-ring-type rotation preventing mechanism 19, in which a rotation preventing pin 19B fitted into a pin hole provided in the front housing 3 is fitted in a slidable manner to the inner circumferential surface of a rotation preventing ring 19A fitted into a ring hole provided in the orbiting end plate 15A of the orbiting scroll 15.

The fixed scroll 14 has, at the center of the fixed end plate 14A, a discharge port 14C through which a compressed refrigerant gas is discharged. A discharge reed valve 21 attached to the fixed end plate 14A via a retainer 20 is disposed at the discharge port 14C. A sealing member 22, such as an O-ring, is disposed on the dorsal-surface side of the fixed end plate 14A so as to be in tight contact with the inner surface of the rear housing 4, thereby forming a discharge chamber 23 divided from the inner space of the housing 2 with respect to the inner surface of the rear housing 4. With this configuration, the inner space of the housing 2, except for the discharge chamber 23, is configured to serve as an intake chamber 24.

The refrigerant gas returning from the refrigeration cycle via an intake port 25 provided in the front housing 3 is taken into the intake chamber 24, via which the refrigerant gas is taken into the compression chambers 16. A sealing member 26, such as an O-ring, is disposed on the bonding surface between the front housing 3 and the rear housing 4 so as to seal the intake chamber 24 formed in the housing 2 from the atmosphere in an air-tight manner.

In the above-described scroll compressor 1, the volumes V1 and V2 of a pair of compression chambers 16 arranged in a symmetrical configuration and formed on the extreme outer circumferential side by the spiral wraps 14B and 15B of the fixed scroll 14 and the orbiting scroll 15, i.e., the volumes V1 and V2 of a pair of compression chambers 16 formed when outer circumferential ends 14F and 15F of the spiral wraps 14B and 15B (see FIG. 2) come into contact with the dorsal-surface side of the spiral wrap of the counterpart scroll, cutting off the intake, are different from each other. FIG. 2 shows the volumes V1 and V2 at a position where the orbiting scroll 15 has turned to the right by approximately 155 degrees from an intake cut-off position.

The relationship between the volume V1 of the compression chamber 16 formed on the ventral-surface side of the fixed spiral wrap 14B of the fixed scroll 14 when the intake is cut off and the volume V2 of the compression chamber 16 formed on the ventral-surface side of the orbiting spiral wrap 15B of the orbiting scroll 15 will be described in detail below using FIGS. 2 and 4. FIG. 2 shows a state in which the orbiting scroll 15 has turned to the right by approximately 155 degrees from when the intake is cut off. In FIG. 2, θ denotes an advancing angle from the outer circumferential ends 14F and 15F of the fixed spiral wraps 14B and the orbiting spiral wrap 15B to positions where the step portions 14E and 15E are provided. Typically, the step portions 14E and 15E are provided at positions at the same advancing angle θ.

However, in this embodiment, the volume V1 of the compression chamber 16 formed on the ventral-surface side of the fixed spiral wrap 14B and the volume V2 of the compression chamber 16 formed on the ventral-surface side of the orbiting spiral wrap 15B are differentiated. Therefore, when the relationship between the volumes V1 and V2 is set such that V1>V2 to obtain a torsional moment that balances and acts in a direction opposite to a torsional moment (rotation moment) in the orbital direction caused by a compression reaction force or a centrifugal force applied to the orbiting scroll 15 during operation, the step portion 14E on the fixed scroll 14 side present in the compression chamber 16 formed on the ventral-surface side of the fixed spiral wrap 14B is shifted toward the inner circumferential end of the fixed spiral wrap 14B by a predetermined angle and is disposed at a position at an advancing angle of θ1. Thus, the volume V1 of the compression chamber 16 formed on the ventral-surface side of the fixed spiral wrap 14B is made larger than the volume V2 of the compression chamber 16 formed on the ventral-surface side of the orbiting spiral wrap 15B.

Conversely to the above, when the relationship between the volumes V1 and V2 is set such that V1<V2 to obtain a torsional moment acting in the same direction as a torsional moment (rotation moment) in the orbital direction caused by a compression reaction force or a centrifugal force applied to the orbiting scroll 15 during operation, the step portion 15E on the orbiting scroll 15 side present in the compression chamber 16 formed on the ventral-surface side of the orbiting spiral wrap 15B is shifted toward the inner circumferential end of the orbiting spiral wrap 15B by a predetermined angle and is disposed at a position at an advancing angle of θ2. Thus, the volume V2 of the compression chamber 16 formed on the ventral-surface side of the orbiting spiral wrap 15B is made larger than the volume V1 of the compression chamber 16 formed on the ventral-surface side of the fixed spiral wrap 14B.

Figure 4:
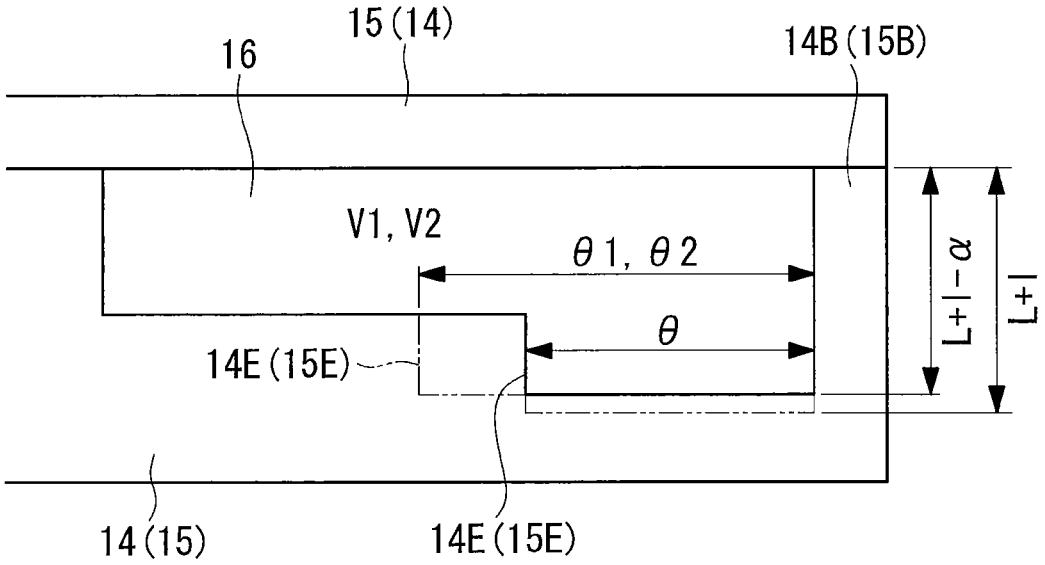
FIG. 4 is a schematic view showing, in an unfolded manner, a compression chamber of the scroll compressor according to the first and second embodiments of the present invention.

As has been described above, it is obvious from the unfolded view shown in FIG. 4 that the volume V1 or V2 can be increased to achieve V1>V2 or V1<V2 by shifting the positions of the step portions 14E and 15E from the positions at an advancing angle of θ to the positions at advancing angle of θ1 or θ2 toward the inner circumferential end of the spiral wraps 14B and 15B. Although the above description has been directed to an example in which the positions of the step portions 14E and 15E of the compression chamber 16 whose volume is to be increased are shifted toward the inner circumferential end of the spiral wraps 14B and 15B, the volumes V1 and V2 of a pair of compression chambers 16 can also be unbalanced by shifting the step portions 14E and 15E of the compression chamber 16 that makes a pair with the compression chamber 16 whose volume is to be increased toward the outer circumferential end of the spiral wraps 14B and 15B.

With the above-described configuration, this embodiment provides the following advantages.

When an external driving source transmits a rotary driving force to the crankshaft 6 via a pulley and an electromagnetic clutch (not shown) to rotate the crankshaft 6, the orbiting scroll 14 connected to the crankpin 6C via the drive bush 10, the cylindrical ring (floating bush) 11, and the drive bearing 12 so as to provide a variable orbital radius is orbitally revolved and driven around the fixed scroll 15 with a predetermined orbital radius, while being prevented from rotating by the pin-ring-type rotation preventing mechanism 19.

When the orbiting scroll 15 is orbitally revolved and driven, refrigerant gas in the intake chamber 24 is taken into a pair of compression chambers 16 formed on the extreme outer circumferential side in the radius direction. After intake is cut off at a predetermined orbit angle position, the compression chambers 16 are moved toward the center while the volume thereof is reduced in the circumferential direction and the wrap height direction. The refrigerant gas is compressed during this time and, when the compression chambers 16 reach positions where they communicate with the discharge port 14C, pushes open the discharge reed valve 21. As a result, the compressed high-temperature, high-pressure gas is discharged into the discharge chamber 23 and is directed outside the scroll compressor 1 via the discharge chamber 23.

During the above-described compression operation, the orbiting scroll 15 receives a torsional moment (rotation moment) in the orbital direction (herein, clockwise) caused by a compression reaction force, a centrifugal force, or the like of the gas. The rotation preventing mechanism 19 receives this torsional moment, thereby preventing the rotation of the orbiting scroll 15. However, because the components of the rotation preventing mechanism 19, the fixed scroll 14, and the orbiting scroll 15 have dimensional tolerances or assembly tolerances, the rotation cannot be completely prevented, and some backlash within the tolerances is allowed.

When the orbiting scroll 15 receives forces in various directions due to this backlash, the behavior thereof becomes unstable, allowing the orbiting scroll to rotate in a rocking (vibrating) manner in the orbital direction or the opposite direction. As a result, the spiral wraps 14B and 15B of the fixed scroll 14 and the orbiting scroll 15, as well as the ring 19A and the pin 19B of the rotation preventing mechanism 19, come into contact with and are separated from each other, causing impact noise and degradation in performance due to gas leakage. To prevent these situations, in this embodiment, the volumes V1 and V2 of a pair of compression chambers 16 formed when the intake is cut off are unbalanced, and a torsional moment in the orbital direction or the opposite direction is applied to the orbiting scroll 15 by the pressure of the compression chamber 16 having a larger volume, thereby stabilizing the behavior of the orbiting scroll 15.

With this configuration, the orbiting scroll 15 can be prevented from rotating in a rocking (vibrating) manner. Therefore, there is no need to set a gap larger than 0 (zero) to give a torsion between the spiral wraps 14B and 15B of the fixed scroll 14 and the orbiting scroll 15 in advance, by cutting the wrap faces or by shifting the positions where the rotation preventing pin and the knock pin are disposed, as in the conventional configuration. Thus, it is possible to prevent a reduction in the absolute value of the performance and the occurrence of abnormal noise, to improve and stabilize the performance, and to reduce operation noise.

More specifically, the relationship between the volume V1 of the compression chamber 16 formed on the ventral-surface side of the fixed spiral wrap 14B of the fixed scroll 14 and the volume V2 of the compression chamber 16 formed on the ventral-surface side of the orbiting spiral wrap 15B of the orbiting scroll 15 is set such that V1>V2 by shifting the position of the step portion 14E on the fixed scroll 14 side toward the inner circumferential end of the wrap to the position at an advancing angle of θ1. Thus, a torsional moment in the orbital direction, which is caused by a compression reaction force or a centrifugal force and is applied to the orbiting scroll 15, can be balanced by a torsional moment in the direction opposite to the orbital direction, which is caused by the pressure of the compression chamber 16 having a larger volume V1 and formed on the ventral-surface side of the fixed spiral wrap 14B.

As a result, the orbiting scroll 15 can be prevented from rotating in a rocking (vibrating) manner in the orbital direction. In particular, it is possible to prevent degradation in performance and the occurrence of abnormal noise due to a torsional moment applied to the orbiting scroll 15, to improve and stabilize the performance, and to reduce operation noise, without providing a gap despite the ideal gap being 0 (zero).

Conversely to the above case, by setting the relationship between the volume V1 of the compression chamber 16 formed on the ventral-surface side of the fixed spiral wrap 14B of the fixed scroll 14 and the volume V2 of the compression chamber 16 formed on the ventral-surface side of the orbiting spiral wrap 15B of the orbiting scroll 15 such that V1<V2 by shifting the position of the step portion 15E of the orbiting scroll 15 toward the inner circumferential end of the wrap to the position at an advancing angle of θ1, even in a case where a torsional moment in the orbital direction applied to the orbiting scroll 15 depending on the operating conditions is reversed, such a moment can be suppressed by a torsional moment in the orbital direction caused by the pressure of the compression chamber 16 formed on the ventral-surface side of the orbiting spiral wrap 15B and having a larger volume V2. Accordingly, it is possible to prevent degradation in performance and the occurrence of abnormal noise due to the reversed torsional moment applied to the orbiting scroll 15, to improve and stabilize the performance, and to reduce operation noise.

For example, in the orbiting scroll 15 with an offset center of gravity (the center of the end plate is offset from the center of the base circle of the spiral wrap), a torsional moment is reversed at the 180 degree completely opposite position in one orbit, which may destabilize the behavior of the orbiting scroll 15 and generate abnormal noise due to switching of the contact of the rotation preventing mechanism 19. However, by generating and applying a torsional moment in the same direction as a torsional moment in the orbital direction, which is caused by a compression reaction force or a centrifugal force and is applied to the orbiting scroll 15, by the pressure of the compression chamber 16 formed on the ventral-surface side of the orbiting spiral wrap 15B having a larger volume V2, the torsional moment can be prevented from being reversed, whereby the contact between the spiral wraps 14B and 15B of the scrolls 14 and 15, as well as the rotation preventing mechanism 19, can be made constantly in one direction. Accordingly, various problems due to the reversed torsional moment applied to the orbiting scroll 15 can be solved.

In addition, the volume V1 of the compression chamber 16 formed on the ventral-surface side of the fixed spiral wrap 14B and the volume V2 of the compression chamber 16 formed on the ventral-surface side of the orbiting spiral wrap 15B can be easily unbalanced by shifting the providing positions of the step portions 14E and 15E present in a pair of compression chambers 16 in the spiral direction. That is, when the volume V1 of the compression chamber 16 formed on the ventral-surface side of the fixed spiral wrap 14B is to be increased, V1>V2 can be achieved by shifting the step portion 14E toward the wrap inner circumferential end. Conversely, when the volume V2 of the compression chamber 16 formed on the ventral-surface side of the orbiting spiral wrap 15B is to be increased, V2>V1 can be achieved by shifting the step portion 15E toward the wrap inner circumferential end. In this manner, the volumes V1 and V2 of a pair of compression chambers 16 can be easily unbalanced by utilizing the structural advantages of the stepped scroll compressor 1.

Second Embodiment

Next, a second embodiment of the present invention will be described using FIGS. 3 and 4.

This embodiment is different from the above-described first embodiment in that the volumes V1 and V2 of a pair of compression chambers 16 are differentiated by changing the height in the axial direction of the spiral wraps on the outer circumferential side. Since the other points are the same as the first embodiment, the descriptions thereof will be omitted.

Figure 3:
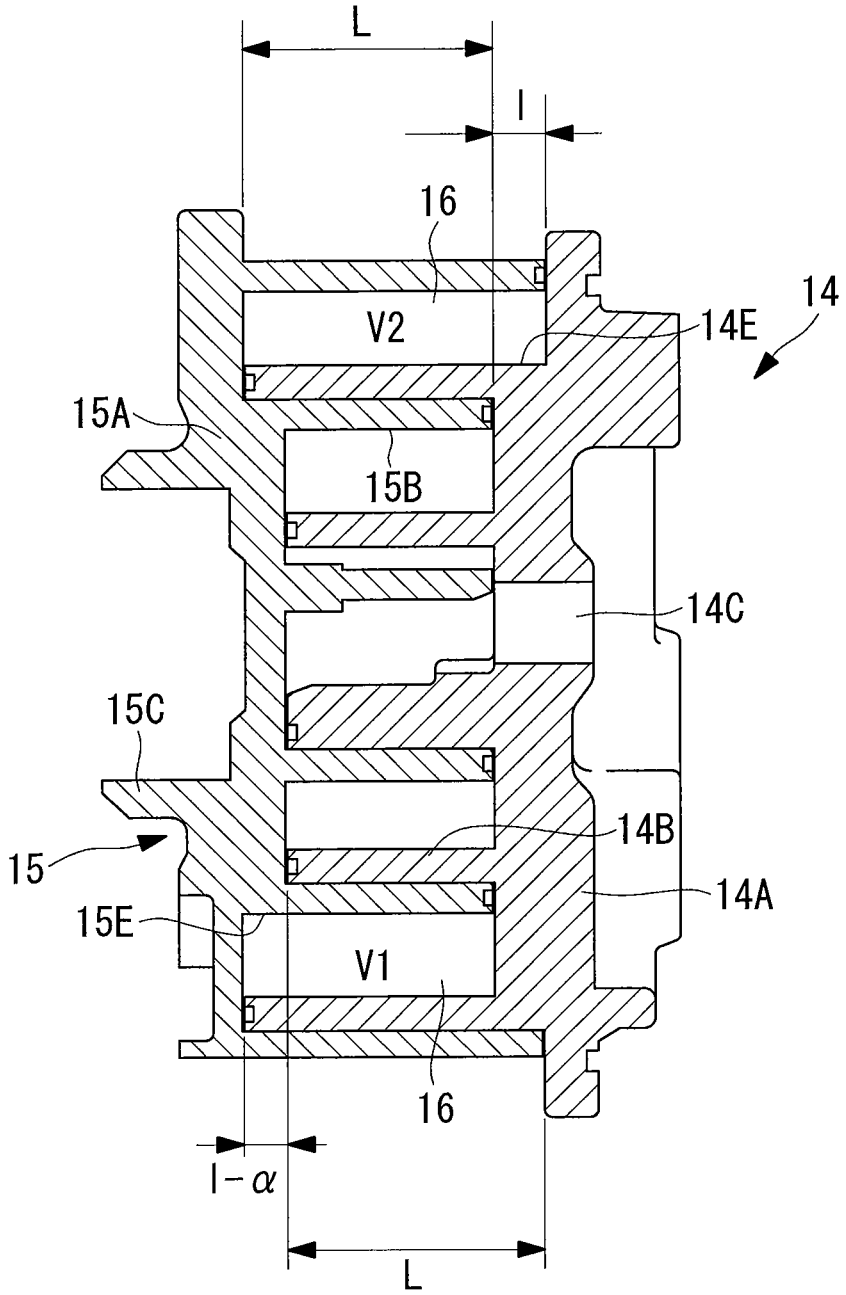
FIG. 3 is a vertical cross-sectional view showing a meshed state of a fixed scroll and an orbiting scroll of a scroll compressor according to a second embodiment of the present invention.

In this embodiment, as shown in FIG. 3, the volume V1 of the compression chamber 16 formed on the ventral-surface side of the fixed spiral wrap 14B and the volume V2 of the compression chamber 16 formed on the ventral-surface side of the orbiting spiral wrap 15B are differentiated by making the spiral wraps 14B and 15B on the outer circumferential end side of the step portions 14E and 15E of the fixed scroll 14 and the orbiting scroll 15 have different heights in the axial direction.

That is, assuming that the dimension from the bottom surface on the outer circumferential side of the step portion 14E (15E) of one scroll 14 (15) to the bottom surface on the inner circumferential side of the step portion 15E (14E) of the other scroll 15 (14) is L, the height of the step portion 14E (15E) of one scroll 14 (15) is l, and the height of the step portion 15E (14E) of the other scroll 15 (14) is l−α, by making the spiral wraps 14B and 15B on the outer circumferential end side of the step portions 14E and 15E have different heights in the axial direction (L+l and L+l−α), the volume V1 of the compression chamber 16 formed on the ventral-surface side of the fixed spiral wrap 14B and the volume V2 of the compression chamber 16 formed on the ventral-surface side of the orbiting spiral wrap 15B are unbalanced (see FIG. 4).

Although FIG. 3 shows an example in which the relationship between the volume V1 of the compression chamber 16 formed on the ventral-surface side of the fixed spiral wrap 14B of the fixed scroll 14 and the volume V2 of the compression chamber 16 formed on the ventral-surface side of the orbiting spiral wrap 15B of the orbiting scroll 15 is such that V1<V2, V1>V2 can be achieved by reversing the relationship between the height l and l−α of the step portions 14E and 15E.

As has been described, by making the spiral wraps 14B and 15B on the outer circumferential end side of the step portions 14E and 15E have different heights in the axial direction (L+l and L+l−α), the volumes V1 and V2 of a pair of compression chambers 16 formed when the intake is cut off can be easily differentiated. That is, when the volume V1 of the compression chamber 16 formed on the ventral-surface side of the fixed spiral wrap 14B is to be increased, V1>V2 can be achieved by increasing the height in the axial direction of the fixed spiral wrap 14B constituting the compression chamber 16 on the outer circumferential side (=the height of the step portion). Conversely, when the volume V2 of the compression chamber 16 formed on the ventral-surface side of the orbiting spiral wrap 15B is to be increased, V2>V1 can be achieved by increasing the height in the axial direction of the orbiting spiral wrap 15B constituting the compression chamber 16 on the outer circumferential side (=the height of the step portion). Accordingly, the volumes V1 and V2 of a pair of compression chambers 16 can be easily unbalanced.

The present invention is not limited to the above-described embodiment, and it can be appropriately modified within a scope not departing from the spirit thereof. For example, although an example in which the invention is applied to an open-type scroll compressor 1 driven by the motive power supplied from the outside has been described in the above-described embodiment, it is of course applicable to a closed-type scroll compressor accommodating an electric motor serving as a motive power source. Although the rotation preventing mechanism 19 for the orbiting scroll 15 has been described as a rotation preventing mechanism of a pin ring type, it may be a rotation preventing mechanism of another type, such as an Oldham's ring type. In addition, the driven crank mechanism is not limited to that according to the above-described embodiments, which is of a swing type, and a driven crank mechanism of another type may be used.

REFERENCE SIGNS LIST

1 scroll compressor
14 fixed scroll
14A fixed end plate
14B fixed spiral wrap
14E step portion
15 orbiting scroll
15A orbiting end plate
15B orbiting spiral wrap
15E step portion
16 compression chamber
19 rotation preventing mechanism
V1 volume of the compression chamber formed on the ventral-surface side of the fixed spiral wrap
V2 volume of the compression chamber formed on the ventral-surface side of the orbiting spiral wrap
θ1 advancing angle of the step portion of the fixed scroll shifted in the spiral direction
θ2 advancing angle of the step portion of the orbiting scroll shifted in the spiral direction
L+l−α height in the axial direction of the orbiting spiral wrap
L+l height in the axial direction of the higher orbiting spiral wrap

The invention claimed is:

1. A scroll compressor comprising:

a fixed scroll in which a fixed spiral wrap is disposed upright on a surface of a fixed end plate;

an orbiting scroll in which an orbiting spiral wrap is disposed upright on a surface of an orbiting end plate, the orbiting scroll being meshed with the fixed scroll, forming a plurality of compression chambers arranged in a point-symmetrical configuration; and a rotation preventing mechanism that allows the orbiting scroll to orbitally revolve around the fixed scroll while preventing rotation of the orbiting scroll, wherein the fixed scroll and the orbiting scroll each have a step portion at an arbitrary position in a spiral direction of the spiral wrap, the spiral wrap having a higher wrap height on an outer circumferential side than on an inner circumferential side, and wherein a pair of compression chambers arranged in a point-symmetrical configuration among the compression chambers are configured such that a volume V1 of the compression chamber formed on a ventral-surface side of the fixed spiral wrap of the fixed scroll and a dorsal-surface side of the orbiting spiral wrap of the orbiting scroll when intake is cut off and a volume V2 of the compression chamber formed on a ventral-surface side of the orbiting spiral wrap of the orbiting scroll and a dorsal-surface side of the fixed spiral wrap of the fixed scroll are differentiated by making a height in an axial direction of an outer circumferential side, from the step portion to an outer circumferential end, of the fixed spiral wrap forming the volume V1 of the compression chamber different from a height in an axial direction of an outer circumferential side, from the step portion to an outer circumferential end, of the orbiting spiral wrap forming the volume V2 of the compression chamber, where volume V1 is sealed from Volume V2 to balance a torsional moment.

2. A scroll compressor according to claim 1, wherein a relationship between the volume V1 of the compression chamber formed on the ventral-surface side of the fixed spiral wrap of the fixed scroll and the volume V2 of the compression chamber formed on the ventral-surface side of the orbiting spiral wrap of the orbiting scroll is V1>V2.

3. A scroll compressor according to claim 2, wherein the volume V1 of the compression chamber formed on the ventral-surface side of the fixed spiral wrap of the fixed scroll and the volume V2 of the compression chamber formed on the ventral-surface side of the orbiting spiral wrap of the orbiting scroll are differentiated from each other by shifting positions at which the step portions present in the compression chambers are provided in the spiral direction.

4. A scroll compressor according to claim 1, wherein a relationship between the volume V1 of the compression chamber formed on the ventral-surface side of the fixed spiral wrap of the fixed scroll and the volume V2 of the compression chamber formed on the ventral-surface side of the orbiting spiral wrap of the orbiting scroll is V1<V2.

5. A scroll compressor according to claim 4, wherein the volume V1 of the compression chamber formed on the ventral-surface side of the fixed spiral wrap of the fixed scroll and the volume V2 of the compression chamber formed on the ventral-surface side of the orbiting spiral wrap of the orbiting scroll are differentiated from each other by shifting positions at which the step portions present in the compression chambers are provided in the spiral direction.

6. A scroll compressor according to claim 1, wherein the volume V1 of the compression chamber formed on the ventral-surface side of the fixed spiral wrap of the fixed scroll and the volume V2 of the compression chamber formed on the ventral-surface side of the orbiting spiral wrap of the orbiting scroll are differentiated from each other by shifting positions at which the step portions present in the compression chambers are provided in the spiral direction.

* * * * *